US006362834B2

(12) United States Patent
Ishii

(10) Patent No.: US 6,362,834 B2
(45) **Date of Patent: *Mar. 26, 2002**

(54) FLAT-PANEL DISPLAY CONTROLLER WITH IMPROVED DITHERING AND FRAME RATE CONTROL

(75) Inventor: Takatoshi Ishii, Sunnyvale, CA (US)

(73) Assignee: S3 Graphics Co., Ltd., Cayman Islands (KN)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/430,999

(22) Filed: Nov. 1, 1999

Related U.S. Application Data

(62) Division of application No. 09/021,718, filed on Feb. 10, 1998, now Pat. No. 6,008,794.

(51) Int. Cl.[7] ..... G09G 5/10
(52) U.S. Cl. ..... 345/690; 345/596; 345/691
(58) Field of Search ..... 345/89, 147, 148, 345/149, 596, 690, 691, 692, 693

(56) References Cited

U.S. PATENT DOCUMENTS 5,677,704 A * 10/1997 Kusano et al. ..... 345/89
5,691,745 A * 11/1997 Mital ..... 345/148
5,748,163 A * 5/1998 Han ..... 345/148
5,757,343 A * 5/1998 Nagakubo ..... 345/148
5,774,101 A * 6/1998 Hirai et al. ..... 345/148
5,805,126 A * 9/1998 Bassetti ..... 345/148
5,844,533 A * 12/1998 Usui et al. ..... 345/89
5,953,002 A * 9/1999 Hirai et al. ..... 345/148
6,020,869 A * 1/2000 Sasaki et al. ..... 345/89

* cited by examiner

*Primary Examiner*—Richard Hjerpe
*Assistant Examiner*—Kimnhung Nguyen
(74) *Attorney, Agent, or Firm*—Carr & Ferrell LLP

(57) ABSTRACT

A flat-panel display controller generates signals to cause display of images on TFT and STN type flat-panel displays. The display controller includes dither logic and frame rate control logic. The dither logic performs dynamic and distributed dithering on pixel data to generate smooth 16 gray-shade images on the display. The dynamic and distributed dithering capabilities are programmable. Dynamic dithering is programmable to specify, two-phase, four-phase or eight-phase mixes to generate signals for use by TFT and STN type flat-panel displays. The frame rate control logic is responsive to the dither logic and performs frame rate control on the dithered signals using stored values indicative of average pixel luminescence to generate 256 gray-shades.

20 Claims, 10 Drawing Sheets

0000

| | | | |
|---|---|---|---|
| 0 | 0 | 0 | 0 |
| 0 | 0 | 0 | 0 |
| 0 | 0 | 0 | 0 |
| 0 | 0 | 0 | 0 |

Figure 5(a)

0001

| | | | |
|---|---|---|---|
| 1 | 0 | 0 | 0 |
| 0 | 0 | 0 | 0 |
| 0 | 0 | 0 | 0 |
| 0 | 0 | 0 | 0 |

Figure 5(b)

0010

| | | | |
|---|---|---|---|
| 1 | 0 | 0 | 0 |
| 0 | 0 | 0 | 0 |
| 0 | 0 | 0 | 1 |
| 0 | 0 | 0 | 0 |

Figure 5(c)

0011

| | | | |
|---|---|---|---|
| 1 | 0 | 1 | 0 |
| 0 | 0 | 0 | 0 |
| 0 | 0 | 0 | 1 |
| 0 | 0 | 0 | 0 |

Figure 5(d)

0100

| | | | |
|---|---|---|---|
| 1 | 0 | 1 | 0 |
| 0 | 0 | 0 | 0 |
| 1 | 0 | 1 | 0 |
| 0 | 0 | 0 | 0 |

Figure 5(e)

0101

| | | | |
|---|---|---|---|
| 1 | 0 | 1 | 0 |
| 0 | 1 | 0 | 0 |
| 1 | 0 | 1 | 0 |
| 0 | 0 | 0 | 0 |

Figure 5(f)

0110

| | | | |
|---|---|---|---|
| 1 | 0 | 1 | 0 |
| 0 | 1 | 0 | 0 |
| 1 | 0 | 1 | 0 |
| 0 | 0 | 0 | 1 |

Figure 5(g)

0111

| | | | |
|---|---|---|---|
| 1 | 0 | 1 | 0 |
| 0 | 1 | 0 | 1 |
| 1 | 0 | 1 | 0 |
| 0 | 0 | 0 | 1 |

Figure 5(h)

1000

| | | | |
|---|---|---|---|
| 1 | 0 | 1 | 0 |
| 0 | 1 | 0 | 1 |
| 1 | 0 | 1 | 0 |
| 0 | 1 | 0 | 1 |

Figure 5(i)

FLAT-PANEL DISPLAY CONTROLLER WITH IMPROVED DITHERING AND FRAME RATE CONTROL

CROSS-REFERENCE TO RELATED APPLICATION

This application claims the benefit and is a divisional of application Ser. No. 09/021,718 filed Feb. 10, 1998, now U.S. Pat. No. 6,008,794 entitled "Flat-Panel Display Controller with Improved Dithering and Frame Rate Control" issued on Dec. 28, 1999, the subject matter of which is hereby incorporated by reference.

FIELD OF THE INVENTION

This invention relates generally to the field of graphics controllers and more particularly to the field of graphics controllers for controlling flat-panel type displays.

BACKGROUND OF THE INVENTION

Portable computers typically include what is called generically a flat panel displays Flat-panel type displays can take a variety of forms, the most common of which is the liquid crystal type display. Liquid crystal displays include active matrix type which are also called TFT (Thin Film Transistor) type and passive matrix type which are also called STN (Super Twisted Nematic) type. Both of these are available in monochromatic or color versions. Such flat panel displays are driven by a controller which is typically a portion of an integrated circuit chip and also is referred to as a display controller or an LCD controller.

Liquid crystal displays have a number of well known characteristics which must be overcome by the associated controller. One characteristic is that if the various display pixels (picture elements) are excited so that adjacent picture elements are excited in the same phase, undesirable visual artifacts appear, degrading the quality of the resulting image. These artifacts include visual flickering, and a streaming motion. Frame Rate Control (FRC), which involves introduction of a phase shift for excitation of adjacent pixels in certain types of LCD controllers, is one technique for reducing certain of the aforementioned characteristics.

STN type displays are typically characterized by a panel response time which indicates the response of the panel to stimulation of the pixels contained therein. Displays with faster response times are generally capable of providing more visually pleasing images and innovations in panel technology are leading to STN panels with response times of approximately 150 milliseconds (ms) and faster to response times of 100 ms. TFT panels are characterized by a faster response time of approximately 60 ms. However, the above described frame rate control technique tends to cause increased flickering in panels with fast response times. In addition, in certain TFT and STN panels, such as those employing pseudo 256 gray-shade display, roughness in the form of dither patterns can appear on the panel. It would therefore be desirable to have a flat-panel display controller which adequately compensates for the aforementioned characteristics to provide visually pleasing images on an associated flat-panel display.

SUMMARY OF THE INVENTION

The present invention advantageously provides a display controller that compensates for the physical characteristics of modern flat-panel type displays to provide visually pleasing images which are free of many of the aforementioned undesirable visual artifacts. In a principal aspect, embodiments of the present invention employ a dither controller which provides distributed and/or dynamic dithering to render smooth 256 gray-shade images on an associated flat-panel display. The aforementioned distributed and dynamic dithering is advantageously programmable to allow for customization and fine tuning of the dither controller with different types of flat-panel displays. A significant advantage of such dithering is increased stability and smoothness in gray-scale shading for TFT and STN type panels. Other embodiments perform phase and intensity control of RGB (Red, Green, Blue) components of pixel data to reduce screen flicker and increase stability in gray-scale shading for STN type panels. In other embodiments, the aforementioned phase and intensity control is responsive to data produced by the aforementioned dynamic and distributed dithering mechanisms.

These and other features and advantages of the present invention may be better understood by considering the following detailed description of a preferred embodiment of the invention. In the course of this description, reference will frequently be made to the attached drawings.

BRIEF DESCRIPTION OF THE DRAWINGS

FIGS. 5(*a–i*) of the drawings are 4×4 matrices of preferred dither bit patterns employed by the dither logic of FIG. 4.

FIG. 9(*b*) of the drawings is a block diagram showing further details of the phase shift logic of FIG. 8.

DETAILED DESCRIPTION OF THE PREFERRED EMBODIMENTS

Figure 1:
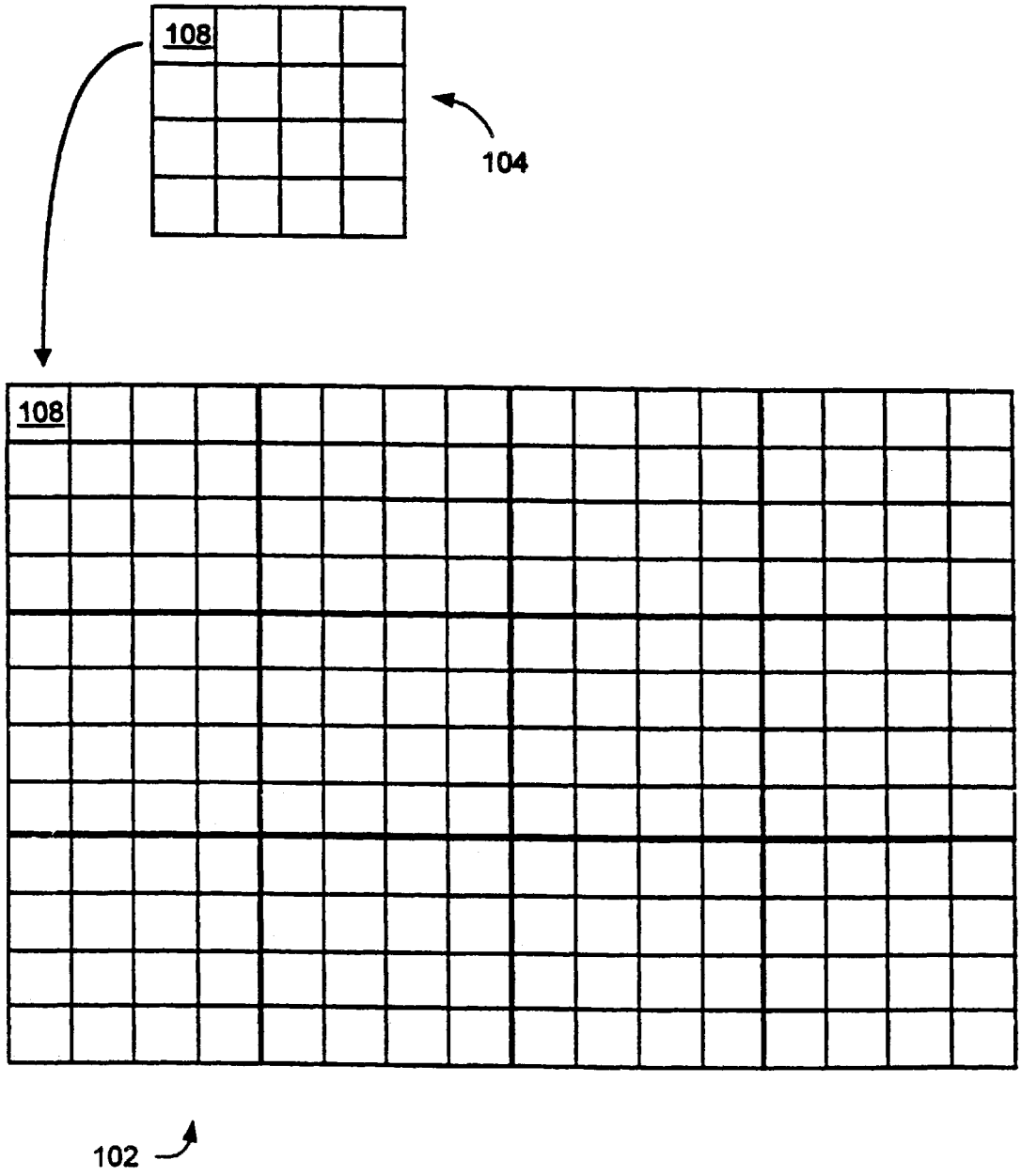
FIG. 1 of the drawings shows an example of the use of dither patterns by a preferred flat-panel interface on a flat-panel type display.

FIG. 1 of the drawings illustrates, by way of an example flat-panel display 102, the application and inter-relationship of the dither patterns explained in further detail herein. In FIG. 1, flat-panel display 102 takes the form of a rectangular grid which comprises a 16×12 (horizontal x vertical) array of pixels 108. The display 102 shown in FIG. 1 is a highly simplified example of actual displays which typically have several hundred to over a thousand pixels in the horizontal and vertical dimensions.

Embodiments described herein perform dithering by applying a pattern, comprising a 4×4 matrix, such as shown at 104, of dither patterns. The dither pattern 104 is applied to the display 102 in an adjacent, non-overlapping fashion to account for all pixels 108 on the display.

Figure 2:
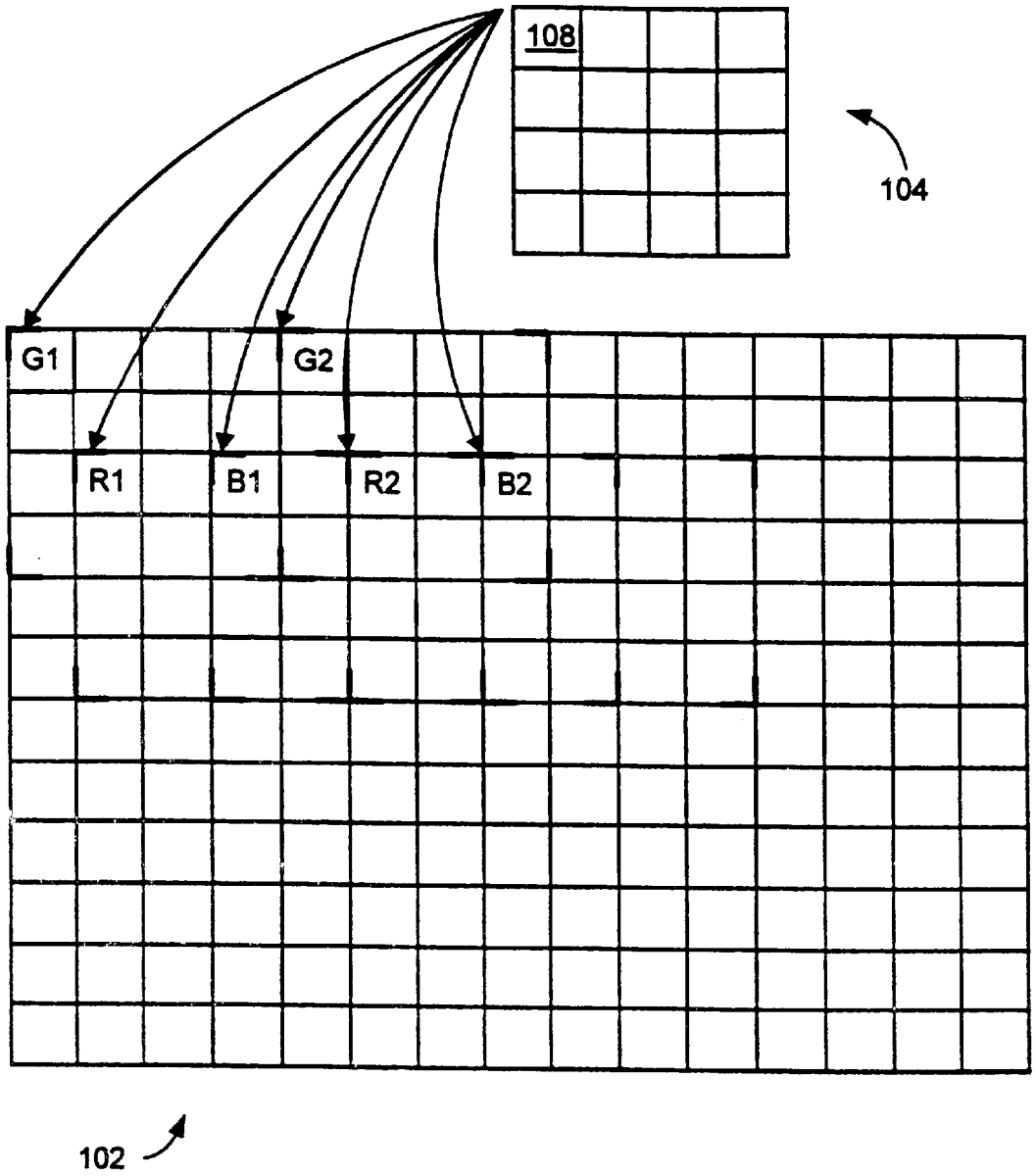
FIG. 2 of the drawings illustrates the operation of distributed dithering on a flat-panel type display by a preferred flat-panel interface.

FIG. 2 of the drawings illustrates the operation of distributed dithering in the context of display 102. The term "pattern origin point" is used herein to refer to the pixel location on display 102 of a predetermined block in dither pattern 104. For example, in the explanations herein, the pattern origin point for a pattern 104 is the pixel 108 in the upper-left corner of the dither pattern 104. In distributed dithering, pattern 104 is applied at different pattern origin points for each RGB component. For example, in FIG. 2, the pattern origin point for a green dither pattern is shown in the pixel designated G1. The green dither pattern is applied again to a 4×4 array of pixels with a pattern origin point 108 designated in FIG. 2 as G2. The pattern origin points for red and blue dither patterns differ from the green pattern origin point, and from one another, and are shown in FIG. 2 respectively at R1 and B1. Subsequent pattern origin points for the red and blue dither patterns are shown respectively at R2 and B2. For ease of understanding, the outer corners of patterns 104 with pattern origin points at R1, G1, B1 and at R2, G2, B2 in FIG. 2 are shown in bold. For simplicity of illustration, only two pattern origin points for each RGB component are shown in FIG. 2. The pattern origin points for each RGB component are reproduced in a manner shown in FIG. 1 to cover all pixels of display 102 with an appropriate dither pattern.

Distributed dithering advantageously increases the smoothness of a displayed image by increasing by three times the number of pixels modulated on the panel 102. In conventional dithering, the RGB components of a pixel are stimulated on the panel 102 together as a single unit. Distributed dithering, as described herein, causes stimulation of the RGB components of a pixel to be spatially distributed by way of separately applied dither patterns 104 for the three RGB components.

Figure 3A:
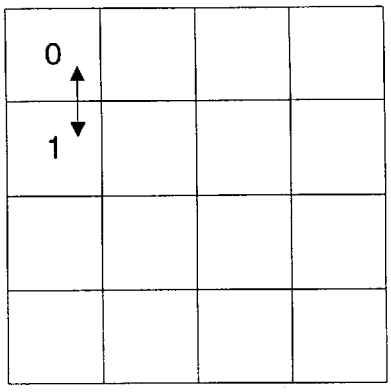
FIGS. 3(*a–c*) of the drawings illustrate the operation of dynamic dithering on a flat-panel type display by a preferred flat-panel interface.
Figure 3B:
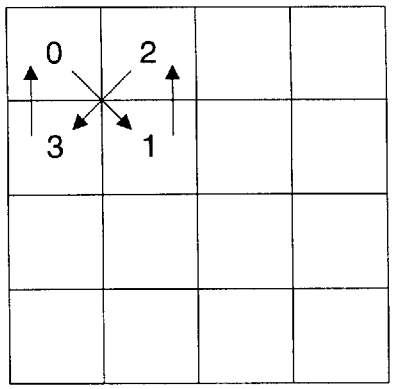
Figure 3C:
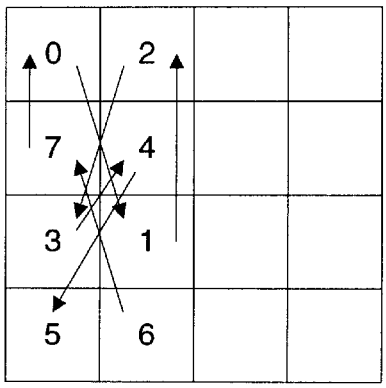

FIGS. 3(*a–c*) of the drawings illustrate the operation of dynamic dithering as performed by preferred embodiments. In dynamic dithering, the pattern origin point for one or more RGB components is shifted dynamically between two or more pattern origin points. FIG. 3(*a*) shows an example of two-phase dynamic dithering in which the pattern origin point is alternated between a first pattern origin point "0" and a second pattern origin point "1". FIG. 3(*b*) shows an example of four-phase dynamic dithering in which the pattern origin point is shifted from a first pattern origin point "0", to a second pattern origin point "1", to a third pattern origin point "2" to a fourth pattern origin point "3", and finally back to the first pattern origin point "0". FIG. 3(*c*) shows an example of eight-phase dynamic dithering in which the pattern origin point is shifted from a first pattern origin point "0", to a second pattern origin point "1", to a third pattern origin point "2", to a fourth pattern origin point "3", to a fifth pattern origin point "4", to a sixth pattern origin point "5", to a seventh pattern origin point "6" to an eighth pattern origin point "7" and finally back to the first pattern origin point "0". Dynamic dithering advantageously increases smoothness of an image.

Figure 4:
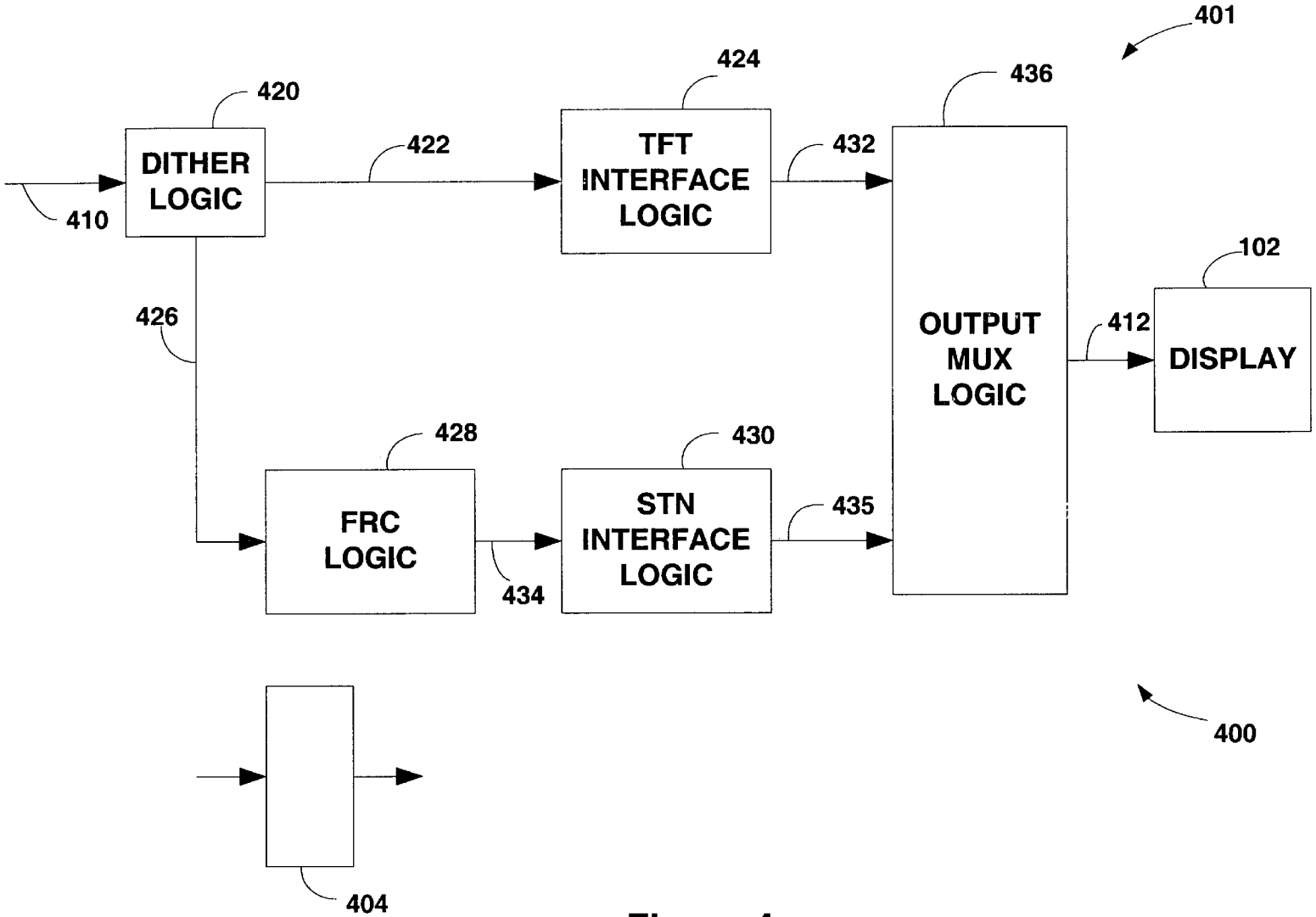
FIG. 4 of the drawings is a block diagram of portions of a preferred flat-panel interface.

FIG. 4 of the drawings shows a block diagram of a preferred flat panel interface 400 that performs distributed and dynamic dithering as described above in addition to performing frame rate control as described in further detail herein. Preferably, the interface 400 shown in FIG. 4 is implemented on an integrated circuit that contains other circuitry required to implement a graphics controller 401 that receives data and commands from a host microprocessor (not shown), stores and retrieves data to a frame buffer memory (not shown) and transmits data and control signals to flat-panel display 102. Interface 400 includes a programmable register 404 which may be programmable by conventional means to specify certain operations and/or modes performed by interface 400, or bit-patterns used by interface 400, described in further detail herein. Interface 400 received RGB (Red Green Blue) encoded pixel data on signal lines 410 directly from a frame buffer memory, or after processing by other portions of the graphics controller 401. Interface 400 outputs a flat-panel interface data signal by signal lines 412. Preferably, the signal lines 410 received by the interface 400 contain a total of 24-bits, 8-bits each for the RGB components. Signal lines 412 preferably contain 36 bits to provide up to 12-bits for each RGB component to panel 102. The number of signal lines per pixel as described above and further herein are merely illustrative of the embodiments described herein. It should be understood that the number of signal lines described herein may be varied without departing from the principles of the present invention.

Dither logic 420 performs distributed and dynamic dithering on pixel data transmitted on signal lines 410 to generate signals 422 for TFT interface logic 424, and signals 426 for FRC (Frame Rate Control) logic 428. Dither logic, as shown in FIGS. 2 and 3 and described above, essentially modifies the spatial relationships between the pixel data on signal lines 410. FRC logic 428 essentially modifies the temporal relationships of the signals received from dither logic 420 by modifying the duty cycle at which the RGB components of the pixels on the panel 102 are stimulated. As used herein, the term frame rate control (FRC) refers to the technique of varying the duty cycle at which pixels on the panel 102 are stimulated in order to generate varying levels of pixel intensity on a STN type panel 102. The result of FRC is commonly referred to as grayscale or grayshades images but it is to be understood that such terms refer also color images in addition to black and white images. FRC can be performed to a variety of levels of luminescence of pixels on panel 102. Sixteen level FRC and eight-level FRC are specifically described herein. The principles described herein, however, are applicable to other FRC levels.

Signal lines 422 preferably comprise 24 lines carrying RGB encoded data of 8-bits per each RGB component. FRC logic 428 receives signals 426 from dither logic 420 and performs RGB associated phase and intensity control on the received data. TFT interface logic 424 and STN interface logic 430 operate conventionally to generate output signals 432 and 435 used by TFT panels and STN panels, respectively. Output mux logic 436 selects signal lines 432 or 435 depending upon whether panel 102 is a TFT type panel or an STN type panel. The type of panel (TFT or STN) 102 is programmable by way of appropriate bits in register 404.

Dither logic 420 performs dithering on the pixel data 410. Advantageously, operation of the dither logic block 420 is independent of the type of panel 102. Dithering is applied independently to the red, green, and blue components of pixel data 410. The number of bits to be dithered (dither base color) is specified by three dither base color bits of register 404 which is explained below.

For TFT panels, the dither base color bits of register 404 are programmed equal to the number of bits/color of the panel 102, therefore such programming differentiates between 9-bit (3-bit/color), 12-bit (4-bit/color), 18-bit (6-bit/color) and 24-bit (8-bit/color) TFT panels as shown in Table 1 below:

TABLE 1

| Register 404 (dither base color bits) | Dither Base Color | Dithered Bit Position | Number of Bits to be Dithered | Number of Bits/Color |
|---|---|---|---|---|
| 000 | 7–0 | — | 0 | 8 |
| 001 | — | — | — | — |
| 010 | — | — | — | — |
| 011 | 7–5 | 4–1 | 4 | 3 |
| 100 | 7–4 | 3–0 | 4 | 4 |
| 101 | 7–3 | 2–0 | 3 | 5 |
| 110 | 7–2 | 1–0 | 2 | 6 |
| 111 | — | — | — | — |

For STN Panels, the dither base color bits are programmed to 100 (binary) with 16-grayscale FRC or to 011 (binary) with 8-grayscale FRC as shown in Table 2 below:

TABLE 2

| Register 404 (dither base color bits) | Dither Base Color | Dithered Bit Position | Number of Bits to be Dithered | Number of FRC Bits/Color |
|---|---|---|---|---|
| 000 | — | — | — | — |
| 001 | — | — | — | — |
| 010 | — | — | — | — |
| 011 | 7–5 | 4–1 | 4 | 3 |
| 100 | 7–4 | 3–0 | 4 | 4 |
| 101 | — | — | — | — |
| 110 | — | — | — | — |
| 111 | — | — | — | — |

Dither logic 420 preferably uses 4-bits for dithering, which is based on an addition process as explained in further detail herein. For 2-bit dither, or if the available dither bits are less than 4-bits, then the remaining least significant dither bits are forced to 0's.

For TFT panels, the base color (bits to dither) is selected from the most significant bits of the input data 410 to the dither logic and dithering carries are added to the least significant bit of the dither base color. Overflow carries are ignored. The dither logic forces 0 on all outputs bits that are not part of the dither base color. For example, if base color bits are 7-5 then bits 4-0 of signal lines 422 are forced to 0's.

For STN panels, the base color (bits to dither) is selected from the most significant 4 or 3-bits of the input data to the dither logic and dithering carries are added to the least significant bit of the dither base color. Overflow carries are not ignored. The dither logic 420 outputs the most significant 5-bits of the added results to the FRC logic 428 by way of signal lines 426. The least significant bit of signal lines 426 are forced to 0 if the dither base color bits are programmed to 011 (binary ).

Dither logic 420 preferably uses the 4×4 dither patterns shown in FIGS. 5(*a–i*). FIGS. 5(*a–i*) each show a 4×4 matrix with each block of the matrix representing a pixel 108 on display 102. The patterns shown in the 4×4 matrices in FIGS. 5(*a–i*) are applied to panel 102 in the manner described above in conjunction with FIGS. 1 and 2. In FIGS. 5(*a–i*) a "1" indicates pixels that are stimulated. Advantageously, dither patterns for 0001 to 1000 are stored in a ROM 608 (shown in FIG. 6) and dither patterns for 1001 to 1111 are derived by inverting patterns for 0111 to 0001 correspondingly. Dither pattern for 0000 is fixed to all 0's. By storing only 8 patterns, a total of 16 patterns can be generated rapidly with a minimal amount of storage. The dither patterns shown in FIG. 5 are used for green data. The dither patterns for red and blue data are the same as those shown in FIG. 5 but are shifted in accordance with the selected dynamic and distributed dithering modes described herein.

Distributed dithering is enabled by setting an enable RGB distributed dither bit in register 404 to a value of "1". This causes RGB dither pattern starting points to be shifted as shown in FIG. 2 and explained above.

When dynamic dither is enabled, the pattern origin point of the dither pattern shown in FIGS. 5(*a–i*) is shifted dynamically every certain frame cycles, which is determined by dynamic dither cycle control bits of register 404. Register 404 preferably includes the following bits to control distributed and dynamic dithering:

| # of bits | Functions | |
|---|---|---|
| 1 | Enable/disable RGB distributed dither | |
| 2 | Dynamic dither phase mix: | |
| | 00 - disable dynamic dither | |
| | 01 - two-phase mix | |
| | 10 - four-phase mix | |
| | 11 - eight-phase mix | |
| 2 | Dynamic dither cycle control | |
| | For STN FRC dither: | For TFT Dither: |
| | 00 - half FRC cycle (9 frames) | 00 - one frame |
| | 01 - one FRC cycle (18 frames) | 01 - two frames |
| | 10 - two FRC cycles (36 frames) | 10 - four frames |
| | 11 - unused | 11 - eight frames |

The pattern origin point of dither pattern 104 is relatively shifted as shown in FIGS. 3(*a–c*) depending on the parameters specified above. As shown in FIG. 3, the pattern origin point can be changed in accordance with a two-phase mix as shown in FIG. 3(*a*), a four-phase mix as shown in FIG. 3(*b*) and an eight-phase mix as shown in FIG. 3(*c*). In a two-phase mix, the pattern origin point is shifted between a first pattern origin point (point 0 in FIG. 3(*a*)) and a second pattern origin point (point 1). In a four-phase mix the pattern origin point is shifted between a first, second, third and fourth pattern origin points, shown in FIG. 3(*b*) as points 0–3. In an eight-phase mix, the pattern origin point is changed from a first through an eighth pattern origin point, shown in FIG. 3(*c*) as points 0–7. Advantageously distributed and dynamic dither may each be specified independently of one another allowing pattern origin points for each of the RGB components of a pixel to be shifted and distributed independently and dynamically.

Figure 6:
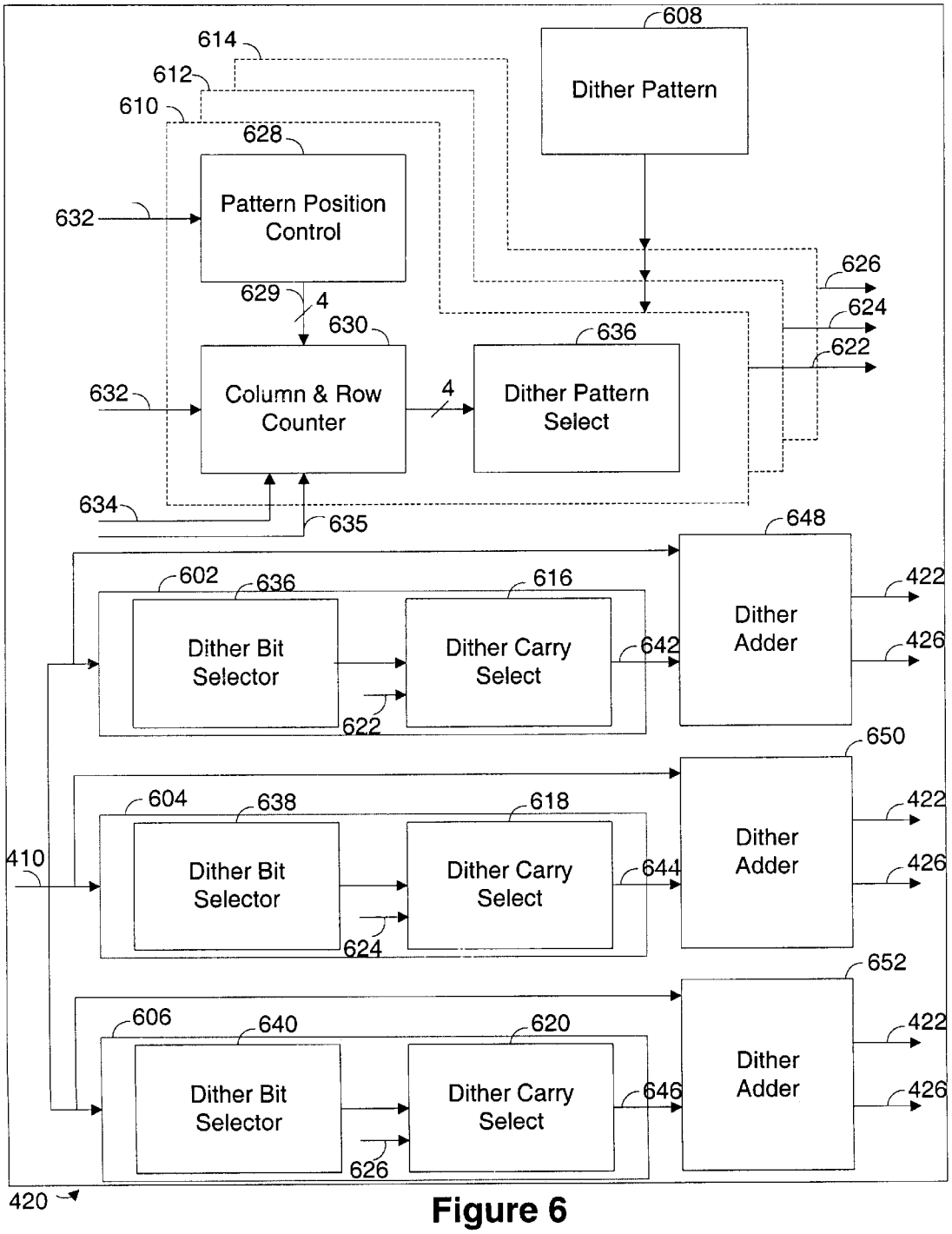
FIG. 6 of the drawings is a block diagram showing further details of the dither logic of FIG. 4.

FIG. 6 of the drawings shows a block diagram of a preferred hardware implementation of dither logic 420. Dither logic 420 receives pixel data signal lines 410, with eight bits of signal lines 410 carrying red components of the pixel data to red dither block 602. Green and blue dither blocks 604 and 606 similarly receive eight signal lines 410 which carry green and blue components, respectively.

Dither pattern registers 608 store the patterns shown in FIGS. 5(*b–i*), The outputs of the dither pattern registers 608 are provided to three identical pattern generation blocks, designated by dotted lines 610, 612 and 614 which select the data stored in registers 608 in accordance with signals received from logic 630. Pattern generation blocks 610, 612 and 614 generate data for red, green and blue dither blocks 602, 604 and 606 respectively, and specifically for dither carry select blocks 616, 618 and 620 respectively, by way of signal lines 622, 624 and 626 respectively.

Pattern position control logic 628 prepares a frame start position of dither pattern 104 independently for each of the RGB components and generates an initial value for column and row counters 630. The pattern origin point for dither patterns 104 are as described above. Column and row counter logic 630 includes 2-bit column and 2-bit row counters to address dither pattern ROM 608. The row counter is preset to frame start value on the beginning of each frame by a conventionally generated vertical sync (VS) signal 632 that indicates vertical retrace. The column counter is preset to line start value at the beginning of each line. These values are as shown below in Table 3. The column counter counts in response to a dot clock (DCLK) signal 634 and the row counter counts in response to a falling edge of a display enable (DE) signal 635. The dot clock signal 634 is a conventional clock signal which operates at a frequency corresponding to the refresh rate of the panel 102. The DE signal 635 is preferably a conventionally generated signal that indicates the display area on the panel 102. In other words, the DE signal 635 is active when the display area on the panel 102 is being scanned and is inactive during the blanking period. Dither pattern select logic 636 selects 8-bit data from the dither pattern ROM 608 specified by row and column position from column and row counter logic 630.

Dither bit selectors 636, 638 and 640 each select a 4-bit output, from the received corresponding 8-bit input from signal lines 410, as specified by a dither bit select value (three bits) programmed into register 404. Dither carry selects 616, 618 and 620 receive 8-bit inputs over signal lines 622, 624 and 626, respectively along with the 4-bit output of the corresponding dither bit selection from blocks 636, 638 and 640. The dither carry selects generate the dither patterns not stored in the dither pattern ROM 608 when necessary. For example, the pattern corresponding to 0000 (binary) shown in FIG. 5(*a*) is not stored in the ROM 608. In addition, the patterns for 1001 to 1111 are not stored in the ROM 608. The dither carry selects 616, 618 and 620 generate the 0000 value when needed and generate the patterns from 1001 to 1111 by inverting corresponding patterns 0111 to 0001 which are stored in ROM 608. The dither carry selects then select 1-bit from the 16-bit data specified by the 4-bit input color number received from the corresponding dither bit selector and generate a 1-bit output of color carry, data, shown at 642, 644 and 646.

Dither adder blocks 648, 650 and 652 each receive eight bits of color data from signal lines 410 together with a color carry input from a corresponding dither carry select block. The dither adders each add the received color carry input to a specified bit in the color data on lines 410. Adding bit position (the least significant bit of base dither color) is specified by three appropriate bits in register 404. The result of the addition will overflow if the dither base color is all ones. The dither adders ignore an overflow condition and output the incoming most significant bits for TFT data outputs 422. For STN outputs 426 the overflow carry is retained resulting in a 5-bit value when the dither base color is all ones.

Figure 7:
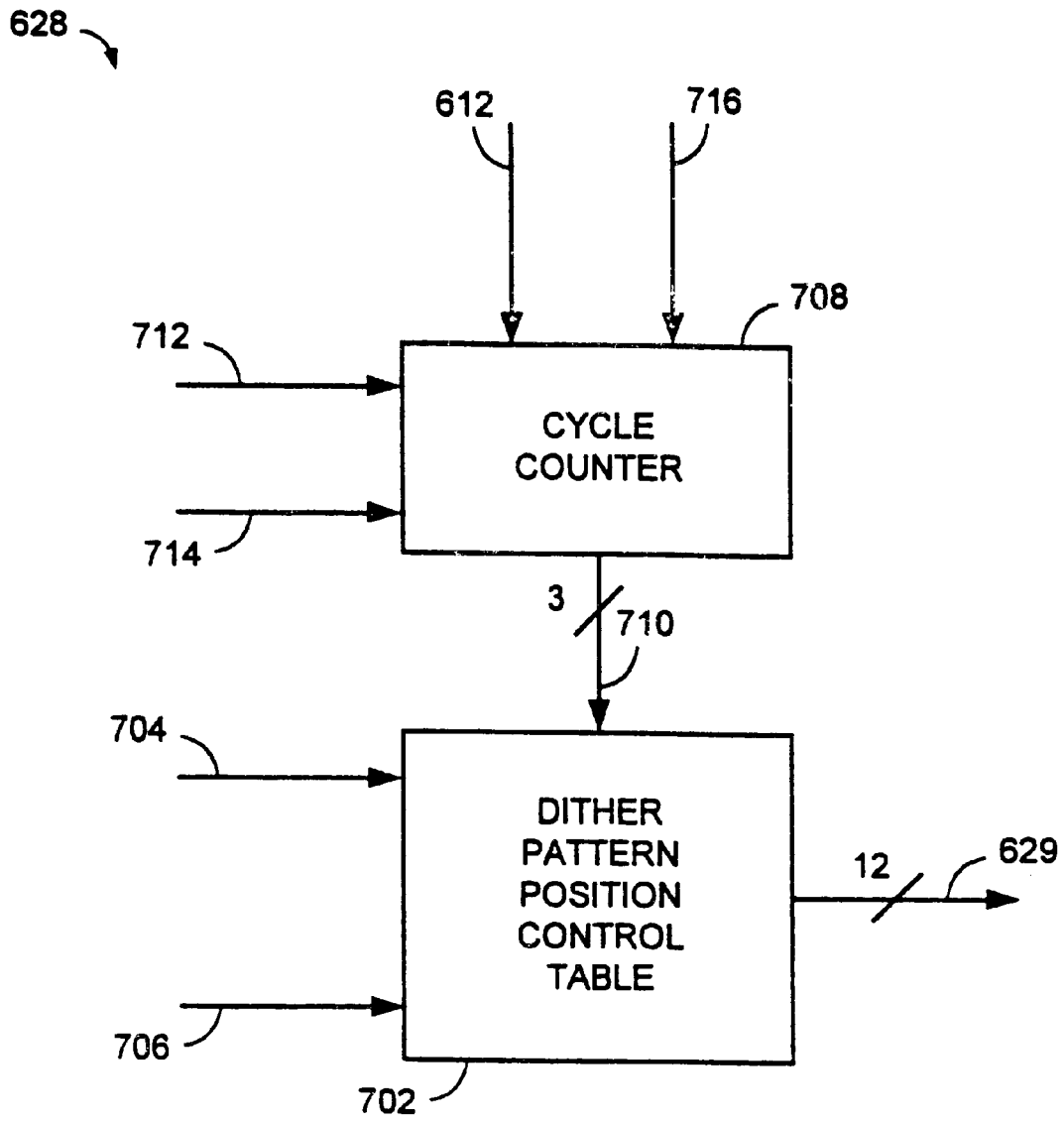
FIG. 7 of the drawings is a block diagram showing further details of the pattern position control logic of FIG. 6.

The pattern position control logic 628 is shown in further detail in FIG. 7. A dither pattern position control table 702 generates frame and line start preset values for row and column counters 630. The dither pattern position control table 702 may be programmed with the values shown in Table 3 below:

TABLE 3

| Input | | | Output | | | | | |
|---|---|---|---|---|---|---|---|---|
| Enable | DDPM | Cycle | RED | | GREEN | | BLUE | |
| RGBD | Mode | Counter | Row | Col. | Row | Col. | Row | Col. |
| 0 | 0 | x | 0 | 0 | 0 | 0 | 0 | 0 |
| 1 | x | 0 | 2 | 3 | 0 | 0 | 2 | 1 |
| 1 | 1 | 1 | 1 | 3 | 3 | 0 | 1 | 1 |
| 1 | 2 | 1 | 1 | 2 | 3 | 3 | 1 | 0 |
| 1 | 2 | 2 | 2 | 2 | 0 | 3 | 2 | 0 |
| 1 | 2 | 3 | 1 | 3 | 3 | 0 | 1 | 1 |
| 1 | 3 | 1 | 0 | 2 | 2 | 3 | 0 | 0 |
| 1 | 3 | 2 | 2 | 2 | 0 | 3 | 2 | 0 |
| 1 | 3 | 3 | 0 | 3 | 2 | 0 | 0 | 1 |
| 1 | 3 | 4 | 1 | 2 | 3 | 3 | 1 | 0 |
| 1 | 3 | 5 | 3 | 3 | 1 | 0 | 3 | 1 |
| 1 | 3 | 6 | 3 | 2 | 1 | 3 | 3 | 0 |
| 1 | 3 | 7 | 1 | 3 | 3 | 0 | 1 | 1 |

The RGBD 704 to the table 702 is preferably programmable by way of register 404. The two DDPM inputs 706 to table 702 are also preferably programmable by way of register 404. Cycle counter 708 generates a 3-bit output for table 702 in accordance with DDCC inputs 712, which are programmable by way of two bits in register 404, TFT/DD input 714 VS input 632 and a reset input (RST) 716.

FRC logic block 428 responds to the dithered pixel data on signal lines 426 (five bits of each red, green, and blue color data from the dither logic 420) and performs 16-grayscale FRC. The 16-grayscale FRC is enabled by setting appropriate bits in register 404 to specify panel 102 to be an STN type panel. The grayscale level is also programmable by way of a grayscale level bit in register 404. Depending on the value of the grayscale level bit in register 404, the 16-grayscale FRC logic can be used to generate 16 graylevels or 8 graylevels and this is summarized as shown in Table 4 below:

TABLE 4

| Grayscale level bit | Bits to FRC | Graylevels (Definition) | Actual Graylevels |
|---|---|---|---|
| 0 | 7–4 | 16 | 17 |
| 1 | 7–5 | 8 | 9 |

Figure 8:
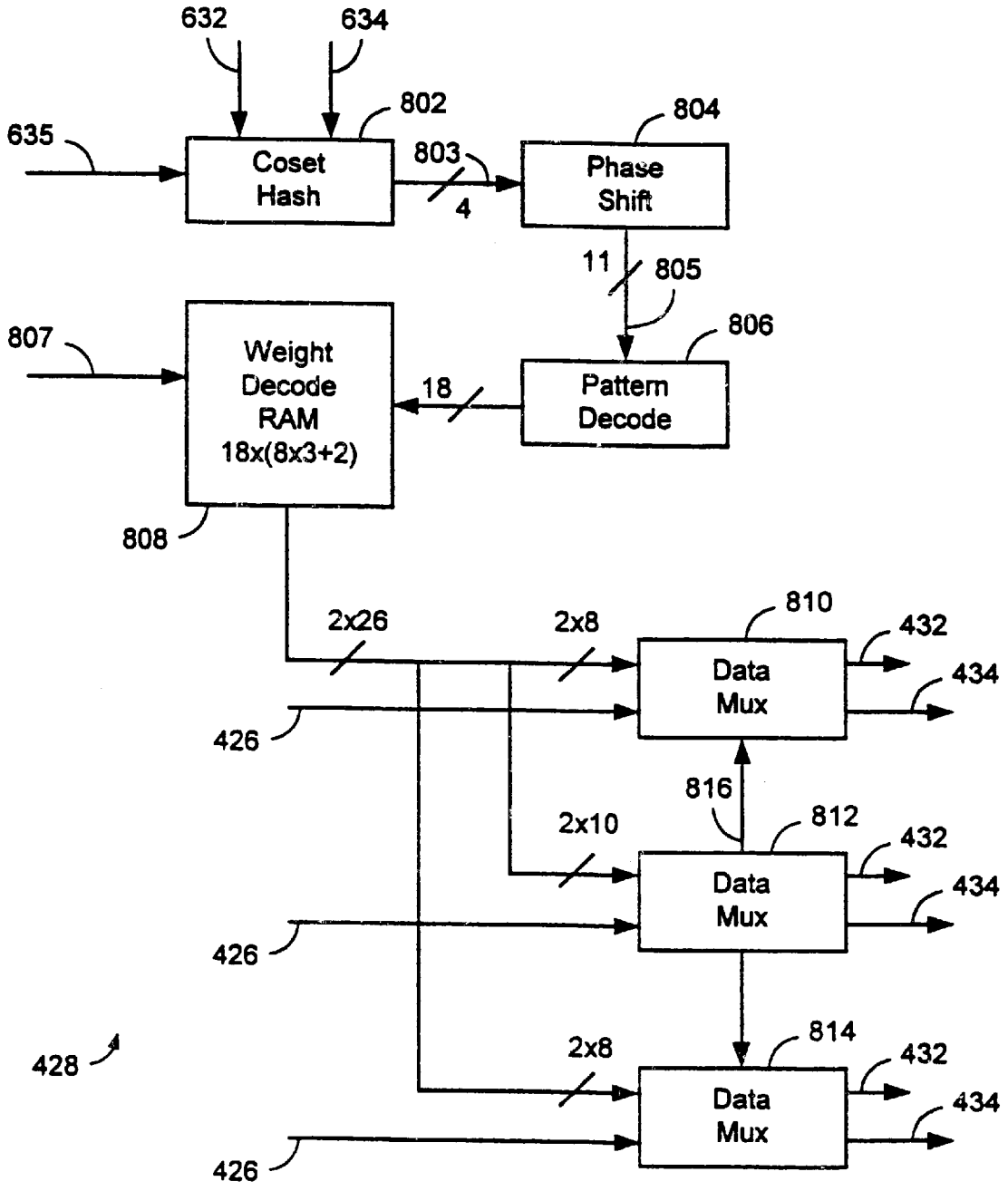
FIG. 8 of the drawings is a block diagram showing further details of the FRC logic of FIG. 4.

The FRC logic block 428 is shown in further detail in FIG. 8. Coset hash block 802 generates a random 4-bit-phase number in response to dot clock signal 634, vertical sync (VS) signal 632 and DE signal 635. Phase shift block 804 receives a 4-bit-phase number (to identify a pixel from a 16×16 block) from coset hash block 802 and scrambles and modifies the phase number to improve the quality of randomness, and outputs 11-bit phase information 805. Pattern decode block 806 decodes the 11-bit phase information 805 and generates 18 decoded weight decode RAM address lines to access the weight decode RAM 808. Coset hash logic 802, phase shift logic 804, pattern decode logic 806 and weight decode RAM 808 operate to generate weight data, for each RGB component, for selection in data MUX's 810, 812, and 814, corresponding respectively to red, green and blue, by respective RGB components of signal lines 426.

Weight Decode RAM 808 preferably stores 18 frame FRC data sets. One data set includes three, 8-bit quantities of weight data and a two-bit modify indicator. The three, 8-bit quantities specify, for each RGB component, average gray-level brightness for eight gray-levels. The two modify bits specify modification of Red and Blue components in a manner explained below.

Weight decode RAM 808 takes the form of a random access memory used to store the basic FRC weights (average graylevel output/brightness) together with two modify bits. Data in RAM 808 is preferably organized in a (3×8+2)×18 format. Each access of the RAM 808 provides three, 8-bit quantities, each of which corresponds to an FRC weight, and two modify bits (M1 and M2), which can be used to force the FRC weights for red and blue components to a "1" or "0" value in a manner described in further detail below. The RAM 808 is preferably accessed by using programmable pointer and data values in register 404. The pointer value is automatically incremented, after data is written or read which allows the weight decode RAM 808 to be programmed with a single pointer value write.

Only graylevels 1 to 8 are stored in the RAM 808. This advantageously reduces the size of the RAM 808. Gray level 0 is fixed to all 0's. Graylevels 9 to 16 are derived by inverting graylevel 7 to 0 correspondingly.

A recommended programming for the FRC weight decode RAM 808 for 18-frame FRC is shown in Table 5 below:

To make stable middle range graylevels, it is necessary for the middle level (level 8) of the FRC display pattern to be perfectly balanced, like 01,01, as shown in Table 5. In other words, a repeating pattern. Levels 7 and 9 display patterns must be close to almost balanced. It is necessary to have 18 frames (an even number and bigger than 17), as shown in Table 5, to provide the 17 necessary graylevels.

On/Off phases for a color R, G, and B display are controlled in associated phases that are separate and which are controlled separately. This allows for brightness compensation between the RGB components which results in elimination of FRC flicker. This control advantageously reduces screen flicker except for a green pure color display which does not have the associated phase differences provided by the red and blue components, as described above, to reduce flicker. This problem can be eliminated however, by enabling weight modification by setting a weight modification bit in register 404 and using two modify bits. This is explained further below.

The FRC weights stored in RAM 808 as shown in Table 5 above, are indicative of an average graylevel output (brightness) of the 17/9-grayscale 18-frame FRC. The correspondence between input color and average graylevel brightness provided by weight decode RAM 808, is shown in Table 6 below, where an average graylevel value of "18" corresponds to white and average graylevel value of "0" corresponds to black:

TABLE 5

| Frame # | Level 8 G,R,B | Level 7 G,R,B | Level 6 G,R,B | Level 5 G,R,B | Level 4 G,R,B | Level 3 G,R,B | Level 2 G,M2,R,B | Level 1 G,M1,R,B |
|---|---|---|---|---|---|---|---|---|
| 0 | 1,0,0 | 1,0,0 | 1,0,0 | 1,0,0 | 1,0,0 | 1,0,0 | 1,–,0,0 | 1,–,0,0 |
| 1 | 0,1,1 | 0,1,1 | 0,1,1 | 0,1,0 | 0,1,0 | 0,0,0 | 0,0,0 | 0,0,0 |
| 2 | 1,0,0 | 1,0,0 | 1,0,0 | 0,0,1 | 0,0,1 | 0,1,0 | 0,0,0 | 0,0,0 |
| 3 | 0,1,1 | 0,1,1 | 0,1,0 | 1,0,0 | 1,0,0 | 0,0,1 | 0,+,1,1 | 0,0,0 |
| 4 | 1,0,0 | 1,0,0 | 0,0,1 | 0,1,0 | 0,0,0 | 1,0,0 | 0,0,0 | 0,+,1,1 |
| 5 | 0,1,1 | 0,1,1 | 1,0,0 | 0,0,1 | 0,1,0 | 0,0,0 | 0,0,0 | 0,0,0 |
| 6 | 1,0,0 | 1,0,0 | 0,1,1 | 1,0,0 | 0,0,1 | 0,1,0 | 1,–,0,0 | 0,0,0 |
| 7 | 0,1,1 | 0,1,0 | 1,0,0 | 0,1,0 | 1,0,0 | 0,0,1 | 0,0,0 | 0,0,0 |
| 8 | 1,0,0 | 0,0,1 | 0,1,0 | 0,0,1 | 0,1,0 | 0,0,0 | 0,0,0 | 0,0,0 |
| 9 | 0,1,1 | 1,0,0 | 0,0,1 | 1,0,0 | 0,0,1 | 1,0,0 | 0,+,1,1 | 1,–,0,0 |
| 10 | 1,0,0 | 0,1,1 | 1,0,0 | 0,1,0 | 1,0,0 | 0,0,0 | 0,0,0 | 0,0,0 |
| 11 | 0,1,1 | 1,0,0 | 0,1,1 | 0,0,1 | 0,0,0 | 0,1,0 | 0,0,0 | 0,0,0 |
| 12 | 1,0,0 | 0,1,1 | 1,0,0 | 1,0,0 | 0,1,0 | 0,0,1 | 1,–,0,0 | 0,0,0 |
| 13 | 0,1,1 | 1,0,0 | 0,1,0 | 0,1,0 | 0,0,1 | 1,0,0 | 0,0,0 | 0,+,1,1 |
| 14 | 1,0,0 | 0,1,1 | 0,0,1 | 0,0,1 | 1,0,0 | 0,0,0 | 0,0,0 | 0,0,0 |
| 15 | 0,1,1 | 1,0,0 | 1,0,0 | 1,0,0 | 0,0,0 | 0,1,0 | 0,+,1,1 | 0,0,0 |
| 16 | 1,0,0 | 0,1,0 | 0,1,0 | 0,1,0 | 0,1,0 | 0,0,1 | 0,0,0 | 0,0,0 |
| 17 | 0,1,1 | 0,1,1 | 0,0,1 | 0,0,1 | 0,0,1 | 0,0,0 | 0,0,0 | 0,0,0 |

The data shown in Table 5 above are preferably the default values after power on. In Table 5, a "1" value for a color component (red, green or blue) indicates stimulation of that particular component, and a "0" value conversely indicates that the corresponding color component is not stimulated. A minus ("–") sign for the modify bits shown in Levels 1 and 2 indicates that the red and blue components are forced to a "0" (off) value and a plus ("+") sign for the modify bits indicates that the red and blue components are forced to a "1" (on) value.

FRC logic 428 advantageously generates 256 actual gray-shades by 16×16 shade interpolations on 17 intensities. 128 actual gray-shades are performed on nine intensities.

TABLE 6

| Input Color from Dither | Average Graylevel Output/Brightness | |
|---|---|---|
| Signals 426 | 17-levels | 9-levels |
| 00000 | 0/18 | 0/18 |
| 00001 | 2/18 | 0/18 |
| 00010 | 3/18 | 3/18 |
| 00011 | 4/18 | 3/18 |
| 00100 | 5/18 | 5/18 |
| 00101 | 6/18 | 5/18 |
| 00110 | 7/18 | 7/18 |
| 00111 | 8/18 | 7/18 |

TABLE 6-continued

| Input Color from Dither Signals 426 | Average Graylevel Output/Brightness 17-levels | 9-levels |
|---|---|---|
| 01000 | 9/18 | 9/18 |
| 01001 | 10/18 | 9/18 |
| 01010 | 11/18 | 11/18 |
| 01011 | 12/18 | 11/18 |
| 01100 | 13/18 | 13/18 |
| 01101 | 14/18 | 13/18 |
| 01110 | 15/18 | 15/18 |
| 01111 | 16/18 | 15/18 |
| 10000 | 18/18 | 18/18 |

RAM 808 receives an 18-bit decoded address and outputs one data set consisting of three, 8-bit values and two modify bits. Data MUX's 810 and 814 receive eight bits each corresponding, respectively, to red and blue components. Data MUX 812 receives eight bits corresponding to a green component and receives the two modify bits. The data MUX's each select one bit specified by incoming 5-bit FRC data on lines 426.

If enable weight modification has been selected by way of register 404 then FRC weight modification is enabled. Weight modification advantageously equalizes brightness and color and decreases flicker by forcing the red and blue components off (i.e. to a "0" value) when the green component is on (i.e. has a "1" value) and forcing the red and blue components on (to a "1" value) when the green component is off (has a "0" value). This is performed by way of plus or minus data information bits 816 and 818 provided by MUX 812 to MUX's 810 and 814 respectively. If a modify bit is "+" (as shown in Table 5), the frame data outputs become one. If a modify bit is "−" (as shown in Table 5), the frame data output becomes zero. This red and blue color modification eliminates pure green flicker as mentioned above.

Figure 9A:
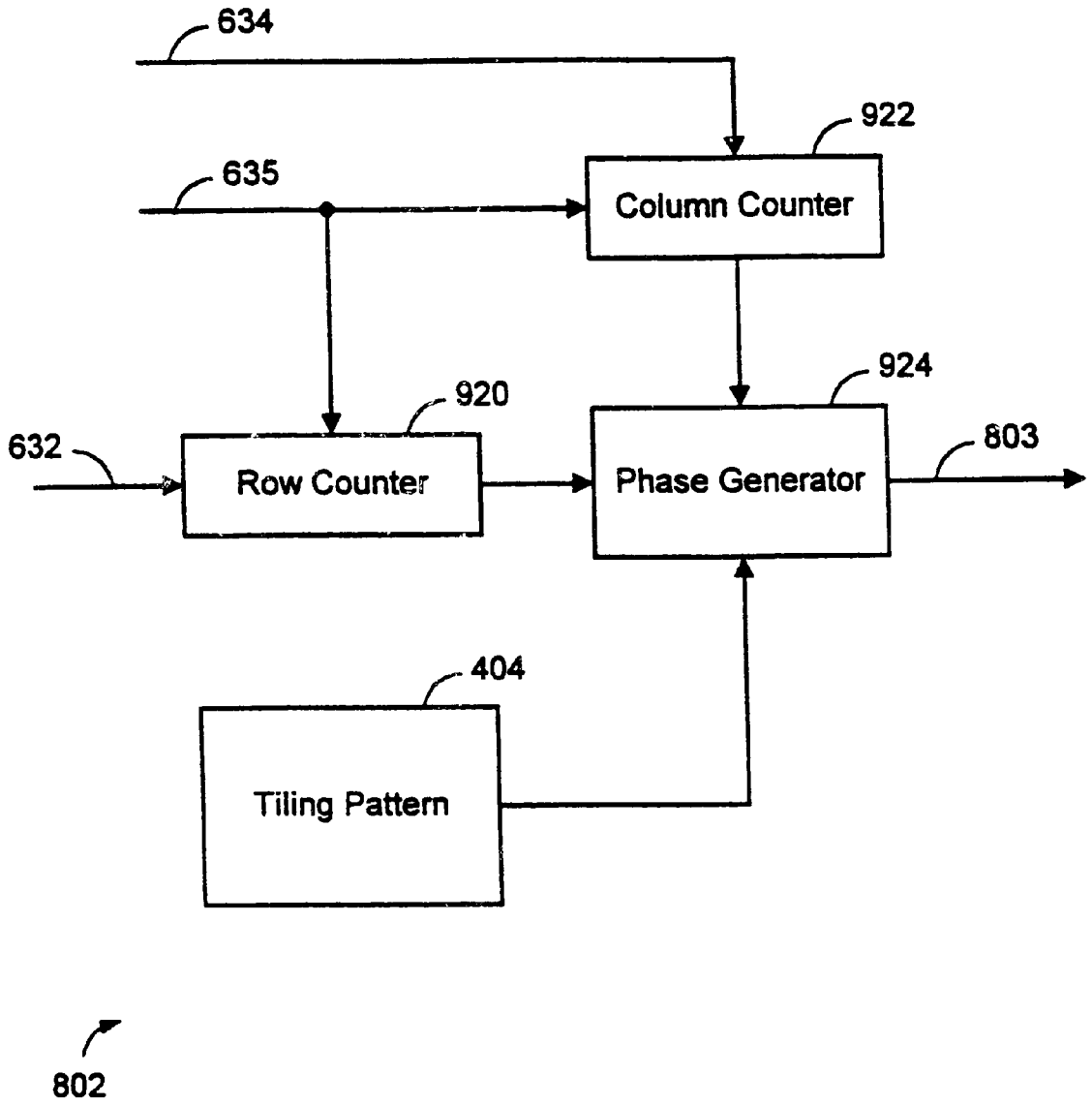
FIG. 9(*a*) of the drawings is a block diagram showing further details of the coset hash logic of FIG. 8.
Figure 9B:
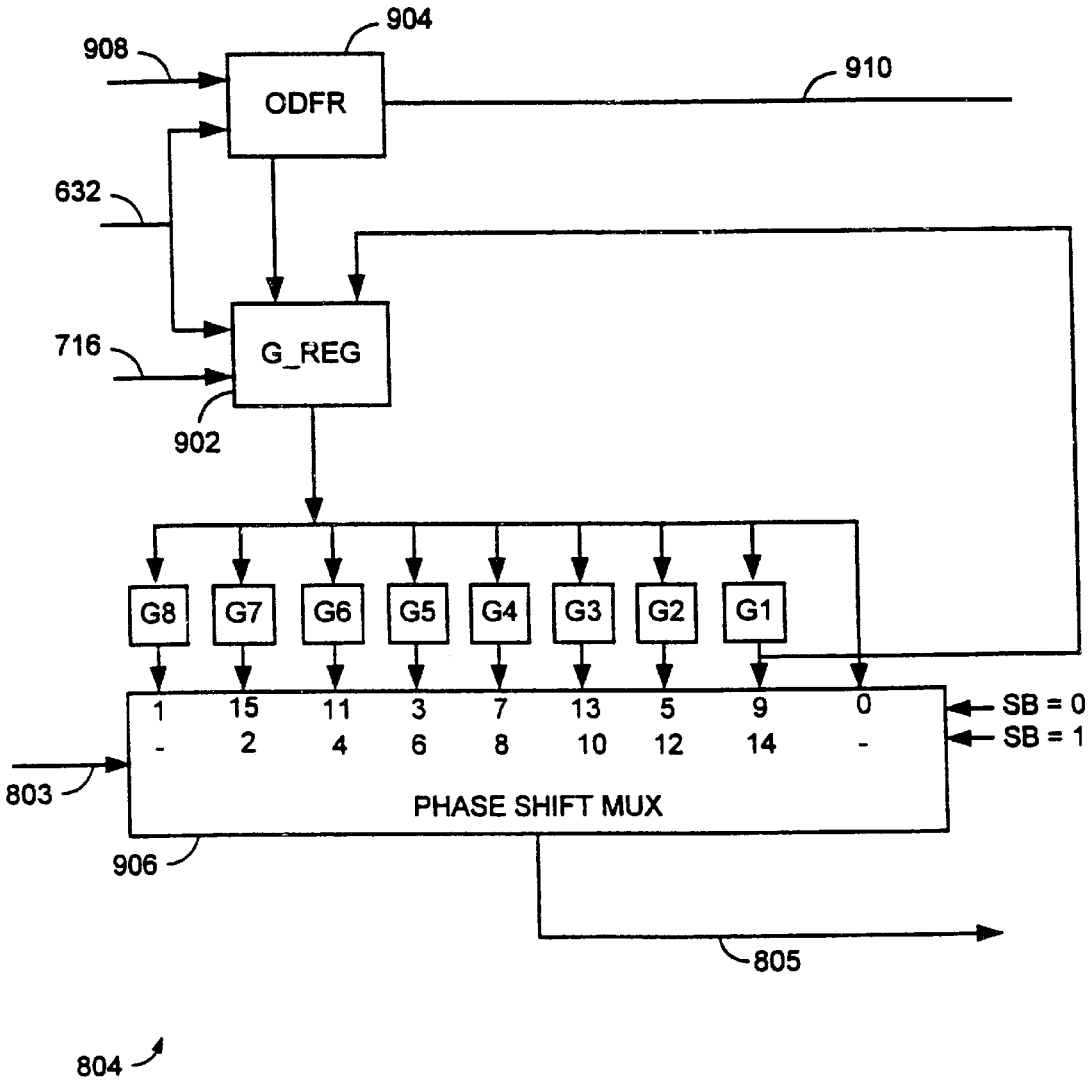

FIG. 9(*a*) shows further details of the coset hash logic 802. A phase generator 924 generates 4-bit phase signal 803 in response to inputs from a row counter 920, a column counter 922 and a programmable tiling pattern 404. Row counter and column counters 920 and 922 are each 4-bit counters. Row counter 920 responds to VS signal 632 and DE signal 635 to generate a 4-bit count indicative of a row in the 16×16 tiling pattern. Column counter 922 responds to DE signal 635 and to lot clock 634 to generate a 4-bit count indicative of a column in the 16×16 tiling pattern. Within the 16×16 tiling pattern, the initial (seed) phase shift of the pixels are generated in phase generator module 924 by a coset hash function which is generated from the following equations:

$$P_0=T_0R_0\oplus T_1R_1\oplus T_2R_2\oplus T_3R_3\oplus C_0$$

$$P_1=T_4R_0\oplus T_5R_1\oplus T_6R_2\oplus T_7R_3\oplus C_1$$

$$P_2=T_8R_0\oplus T_9R_1\oplus T_{10}R_2\oplus T_{11}R_3\oplus C_2$$

$$P_3=T_{12}R_0\oplus T_{13}R_1\oplus T_{14}R_2\oplus T_{15}R_3\oplus C_3$$

where:

$P_{3\text{-}0}$=4-bit phase signal 803;

$T_{15\text{-}0}$=16-bit tiling pattern programmable by way of register 404;

$R_{3\text{-}0}$=4-bit row counter 920;

$C_{3\text{-}0}$=4-bit column counter 922; and $\oplus$=an exclusive-or operation Note that the coset hash function output has only 16 possibilities. However, for 18-frame FRC, the FRC is on an 18-frame cycle, therefore two of the 18 possible phases are never selected without any modification. Also, since the coset hash function always produces an increasing pattern from 0 (hexadecimal) to F (hexadecimal) for the first row ($R_{3\text{-}0}$=0 hex) of the 16×16 tiling pattern, the output of the coset hash function is then 'scrambled and modified' to improve the 'randomness' quality and to select all 18 possible phases at least one time (or two times) within 32 frames. This process is done in phase shift logic 804 as explained below.

Phase shift logic 804, shown in further detail in FIG. 9(*b*), includes a 9-bit G register 902 that produces a 9-bit output to generate the 9-phase cycles shown in Table 7 below:

TABLE 7

| Cycle | Phase |
|---|---|
| 0 | 000000001 |
| 1 | 000000010 |
| 2 | 000000100 |
| 3 | 000001000 |
| 4 | 000010000 |
| 5 | 000100000 |
| 6 | 001000000 |
| 7 | 010000000 |
| 8 | 100000000 |

The value of the 9-bit G register 902 basically represents the 'modulo-9' decoded frame number. The G register 902 is initialized to 000000001 (binary) upon reset or when panel 102 is disabled. The new content of the G register 902 ($q'_{8\text{-}0}$) is generated by rotating left bit, or alternatively, by multiplying a 9×9 G matrix with the previous content of the G register ($q_{8\text{-}0}$), as shown below:

$$q' = G * q \Leftrightarrow \begin{bmatrix} q'_8 \\ q'_7 \\ q'_6 \\ q'_5 \\ q'_4 \\ q'_3 \\ q'_2 \\ q'_1 \\ q'_0 \end{bmatrix} = \begin{bmatrix} 010000000 \\ 001000000 \\ 000100000 \\ 000010000 \\ 000001000 \\ 000000100 \\ 000000010 \\ 000000001 \\ 100000000 \end{bmatrix} * \begin{bmatrix} q_8 \\ q_7 \\ q_6 \\ q_5 \\ q_4 \\ q_3 \\ q_2 \\ q_1 \\ q_0 \end{bmatrix} \quad \text{or:} \quad \begin{matrix} q'_8 = q_7 \\ q'_7 = q_6 \\ q'_6 = q_5 \\ q'_5 = q_4 \\ q'_4 = q_3 \\ q'_3 = q_2 \\ q'_2 = q_1 \\ q'_1 = q_0 \\ q'_0 = q_8 \end{matrix}$$

The ODFR (Odd Frame) indicator 904 toggles every other frame in response to the VS (vertical sync) signal and the G register 902 counts up only when ODFR is on (this means it counts up every other frame by VS, too). The count up is initiated by loading the value stored in the G1 register by way of signal lines 912 on the edge of VS signal. Odd frame indicator (ODFR) 904 generates an ODFR signal 910 which toggles every other frame to distinguish odd frames from even frames. The 9-phase cycles generated by register 902 together with even/odd sub-cycles provided by ODFR indicator 904 result in 18-frame cycles.

The content of the G register 902 (which represents a modulo-9 frame number) is used as an input to modules G1 to G8. The output of G register 902 together with output of modules G1 to G8 is provided to phase shift MUX 906 which selects one of the nine inputs in response to signal lines 803 generated by coset hash logic 802. Modules G1 to G8 represent a shift of 1 to 8 of the current content of the G register 902. Phase shifting is implemented by matrix multiplication of the 9×9 matrix and the content of the G register. Alternatively, a rotate operation, as mentioned above can be performed. For a shift of n phases, a $G^n$ matrix is used.

Phase shift MUX 906 outputs a 9-bit decoded phase plus one additional bit called SB (Sub-Bit). In FIG. 9(*b*), the numbers on the upper and lower rows of the phase shift MUX 906 refer to selecting G phases by signal lines 803. The upper row numbers correspond to SB bit=0 and the lower row numbers correspond to SB bit=1. The ODER signal 910 also goes to the pattern decode block 806 to provide a total of 11-bits provided to pattern decode logic 806.

Note that there are 9 possible phase shifts ($G^0$ to $G^8$) that can be generated. $G^0$ and $G^8$ are selected once and $G^1$ to $G^7$ are selected twice within 16 phase shift cycles.

Table 8 below shows $G^1$ to $G^8$ matrices:

TABLE 8

| $G^n$ | Matrix | $G^n$ | Matrix | $G^n$ | Matrix | $G^n$ | Matrix |
|---|---|---|---|---|---|---|---|
| $G^1$ | 010000000 | $G^2$ | 001000000 | $G^3$ | 000100000 | $G^4$ | 000010000 |
| | 001000000 | | 000100000 | | 000010000 | | 000001000 |
| | 000100000 | | 000010000 | | 000001000 | | 000000100 |
| | 000010000 | | 000001000 | | 000000100 | | 000000010 |
| | 000001000 | | 000000100 | | 000000010 | | 000000001 |
| | 000000100 | | 000000010 | | 000000001 | | 100000000 |
| | 000000010 | | 000000001 | | 100000000 | | 010000000 |
| | 000000001 | | 100000000 | | 010000000 | | 001000000 |
| | 100000000 | | 010000000 | | 001000000 | | 000100000 |
| $G^5$ | 000001000 | $G^6$ | 000000100 | $G^7$ | 000000010 | $G^8$ | 000000001 |
| | 000000100 | | 000000010 | | 000000001 | | 100000000 |
| | 000000010 | | 000000001 | | 100000000 | | 010000000 |
| | 000000001 | | 100000000 | | 010000000 | | 001000000 |
| | 100000000 | | 010000000 | | 001000000 | | 000100000 |
| | 010000000 | | 001000000 | | 000100000 | | 000010000 |
| | 001000000 | | 000100000 | | 000010000 | | 000001000 |
| | 000100000 | | 000010000 | | 000001000 | | 000000100 |
| | 000010000 | | 000001000 | | 000000100 | | 000000010 |

The output 803 of the coset hash function selects the output of the $G^n$ blocks and the SB as shown in Table 9 below to improve the 'randomness' quality of the pixels selected in the 16×16 tiling pattern. The randomization is further improved by using the nine-bit output of the G register 902 to generate eight additional nine-bit quantities selectable by way of the signal 803. The output of the phase shift logic 804 in response to the signals 803 shown in Table 9 below:

TABLE 9

| Output of | Output of Phase Shift | |
|---|---|---|
| Coset Hash | $G^n$ | SB |
| 0000 | $G^0$ | 0 |
| 0001 | $G^8$ | 0 |
| 0010 | $G^7$ | 1 |
| 0011 | $G^5$ | 0 |
| 0100 | $G^6$ | 1 |
| 0101 | $G^2$ | 0 |
| 0110 | $G^5$ | 1 |
| 0111 | $G^4$ | 0 |
| 1000 | $G^4$ | 1 |
| 1001 | $G^1$ | 0 |
| 1010 | $G^3$ | 1 |
| 1011 | $G^6$ | 0 |

TABLE 9-continued

| Output of | Output of Phase Shift | |
|---|---|---|
| Coset Hash | $G^n$ | SB |
| 1100 | $G^2$ | 1 |
| 1101 | $G^3$ | 0 |
| 1110 | $G^1$ | 1 |
| 1111 | $G^7$ | 0 |

The outputs 805 of the phase shift logic 804 are the 9-bit decoded phase shift value (PHASE 8-0) plus the SB bit. The even/odd frame cycle indicator ODFR signal 910 comprises the eleventh bit provided to pattern decode logic 806.

The 9-bit decoded phase shift information, SB bit, and ODFR signals are converted and decoded by pattern decode logic 806 to actual frame number as shown in Table 10 below:

TABLE 10

| Phase Shift Output | | Actual Frame # | Actual Frame # |
|---|---|---|---|
| Decoded | SB | ODFR = 0 | ODFR = 1 |
| 000000001 | 0 | 0 | 1 |
| 000000001 | 1 | 1 | 2 |
| 000000010 | 0 | 2 | 3 |
| 000000010 | 1 | 3 | 4 |
| 000000100 | 0 | 4 | 5 |
| 000000100 | 1 | 5 | 6 |
| 000001000 | 0 | 6 | 7 |
| 000001000 | 1 | 7 | 8 |
| 000010000 | 0 | 8 | 9 |
| 000010000 | 1 | 9 | 10 |
| 000100000 | 0 | 10 | 11 |
| >00100000 | 1 | 11 | 12 |
| 001000000 | 0 | 12 | 13 |
| 001000000 | 1 | 13 | 14 |
| 010000000 | 0 | 14 | 15 |
| 010000000 | 1 | 15 | 16 |
| 100000000 | 0 | 16 | 17 |
| 100000000 | 1 | 17 | 0 |

The pattern decode block 806 then decodes the 9-bit decoded phase shift information, SB bit, and ODFR indicator to 18 address lines to be used to select one 13-bit quantity in the FRC weight decode RAM 808 that corresponds to data for current frame for RGB level 1 h (2/18) to graylevel 8 h (9/18) and two modify bits. An example frame sequence is shown in Table 10. In the example shown in Table 10, the randomized starting frame is designated with a > symbol. The sequence starts at frame 11 (phase "000100000", with SB=1). The subsequent frames are shown in bold. Frame 11–17 are retrieved and/or generated from RAM 808, followed by frames 0–10.

Each one of the three data MUX blocks 810, 812 and 814 then selects one bit of FRC output data based on the color data value from dither logic 420 and a programmable value in register 404 which indicates the number of FRC graylevels (either 16 levels or 8 levels are selected).

The output 434 of the FRC logic is provided to STN interface logic 430 which operates in a conventional manner to format data received on signal lines 434 to correspond to the requirements of STN panel 102. The output 422 of the dither logic 420 is provided to TFT interface logic 424 which operates in a conventional manner to format data received on signal lines 422 to correspond to the requirements of TFT panel 102.

It is to be understood that the specific mechanisms and techniques, discussed herein are merely illustrative of exemplary applications of the principles of the invention. Numerous modifications may be made to the methods and apparatus described without departing from the true spirit and scope of the invention. For example, the embodiments described herein for STN panels are illustrative of a controller for use with a Single Scan-STN type panel. However, such embodiments may be modified to include frame acceleration logic to provide the additional data required by Dual Drive-STN type panels. Other modifications will also be apparent to those skilled in the art in view of the present specification.

What is claimed is:

1. A graphics controller for generating gray-scale images on an STN type flat panel display by modulating a rate at which pixels on the display are stimulated, the graphics controller comprising :

a programmable frame rate control register for specifying a frame rate control weight modification mode; and a frame rate controller, responsive to said frame rate control weight modification mode and to pixel data, for generating temporally distributed excitation signals for components of said pixels of said display in accordance with stored values indicative of average gray level of each of said components.

2. The graphics controller as set forth in claim 1 wherein said frame rate controller further comprises means for retrieving said stored values in accordance with a randomly generated address value.

3. The graphics controller as set forth in claim 2 wherein said means for retrieving said stored values comprises a random number generator for generating a first address value.

4. The graphics controller as set forth in claim 3 wherein said means for retrieving said stored values further comprises a phase shifter for modifying said first address value to generate a second address value.

5. The graphics controller as set forth in claim 4 wherein said means for retrieving said stored values further comprises a decoder, responsive to said second address value, for generating a third address value that causes retrieval of said stored values from a location corresponding to said third address value.

6. The graphics controller as set forth in claim 1 wherein said pixel data comprises RGB components and wherein said frame rate controller further comprises means for generating said temporally distributed excitation signals for said RGB components in a randomized pattern.

7. The graphics controller as set forth in claim 1 wherein said pixel data comprises RGB components and wherein said frame rate controller further comprises means for generating said temporally distributed excitation signals individually for each of said RGB components.

8. The graphics controller as set forth in claim 1 wherein said pixel data comprises RGB components and wherein said frame rate controller further comprises means for generating said temporally distributed excitation signals in a predetermined phase relationship for each of said RGB components.

9. The graphics controller as set forth in claim 1 wherein said pixel data comprises RGB components and wherein said frame rate controller further comprises means for forcing red and blue components of said RGB components to a value determined by a corresponding green component of said RGB components.

10. A graphics controller comprising:

a programmable frame rate control register for specifying a frame rate control weight modification mode;

a frame rate controller, responsive to said frame rate control weight modification mode and to pixel data, for generating temporally distributed excitation signals for components of said pixels of said display in accordance with stored values indicative of average gray level of each of said components;

a programmable dither control register for specifying a distributed dither mode; and a dither controller for generating dither signals to cause stimulation in a predetermined pattern, starting at a pattern origin point, of RGB components of certain pixels of said array of pixels, said dither controller responding to said distributed dither mode by generating a different pattern origin point for at least a first and a second of said RGB components.

11. A graphics controller comprising:

a programmable frame rate control register for specifying a frame rate control weight modification mode;

a frame rate controller, responsive to said frame rate control weight modification mode and to pixel data, for generating temporally distributed excitation signals for components of said pixels of said display in accordance with stored values indicative of average gray level of each of said components;

a programmable dither control register for specifying at least a first dither phase mix; and a dither controller for generating dither signals to cause energization in a predetermined pattern, starting at a pattern origin point, of certain pixels of said array of pixels, said dither controller responding to said first dither phase mix by alternating said pattern origin point between a first pixel in said array of pixels and a second pixel in said array of pixels.

12. The graphics controller as set forth in claim 11 wherein said pixel data contains RGB components and wherein said programmable dither control register further specifies a distributed dither mode, said dither controller being further responsive to said distributed dither mode for generating a different pattern origin point for at least a first and a second of said RGB components.

13. The graphics controller as set forth in claim 12 further comprising a dither pattern control table for storing values corresponding to said pattern origin points.

14. The graphics controller as set forth in claim 11 wherein said dither control register specifies a second dither phase mix and wherein said dither controller responds to said second dither phase mix by alternating said pattern origin point between said first pixel, said second pixel, a third pixel and a fourth pixel.

15. The graphics controller as set forth in claim 14 wherein said dither control register specifies a third dither phase mix and wherein said dither controller responds to said third dither phase mix by alternating said pattern origin point between said first pixel, said second pixel, said third pixel, said fourth pixel, a fifth pixel, a sixth pixel, a seventh pixel and an eighth pixel.

16. The graphics controller as set forth in claim 11 further comprising a frame rate controller, responsive to said dither controller, for modifying said dither signals in accordance with weighting values indicative of average pixel luminescence to generate said flat-panel display signals.

17. The graphics controller as set forth in claim 16 wherein at least certain of said weighting values are stored values.

18. The graphics controller as set forth in claim 16 wherein said frame rate controller comprises:

a memory for storing a plurality of said weighting values;

a phase number generator for generating a random phase number;

a memory address generator, responsive to said phase number generator, for generating and address, to retrieve said weighting values from said memory in accordance with said random phase number; and a plurality of selectors, responsive to said weighting values for generating said flat-panel display signals by selecting certain bits from said dither signals.

19. The graphics controller as set forth in claim 11 wherein said dither controller comprises:

a memory for storing a plurality of dither patterns;

pattern select logic for selecting patterns from said memory; and means for generating said dither signals as a function of said pixel data and a selected one of said dither patterns.

20. The graphics controller as set forth in claim 19 wherein said means for generating said dither signals comprises:

bit selection means for generating selection bits from said pixel data in accordance with a programmable bit selection value;

carry select means for generating carry bits by selecting bits of said dither pattern in accordance with said selection bits; and adder means for adding said carry bits to programmable ones of said pixel data to generate said dither signals.

* * * * *